US008479675B2

(12) United States Patent
Allegrini

(10) Patent No.: US 8,479,675 B2
(45) Date of Patent: Jul. 9, 2013

(54) SYSTEM AND METHOD FOR LEVELLING A PLANE WITH RESPECT TO A MOVABLE REFERENCE

(76) Inventor: Ottaviano Allegrini, Bergamo (IT)

( * ) Notice: Subject to any disclaimer, the term of this patent is extended or adjusted under 35 U.S.C. 154(b) by 236 days.

(21) Appl. No.: 13/122,742

(22) PCT Filed: Oct. 7, 2008

(86) PCT No.: PCT/IT2008/000634
§ 371 (c)(1),
(2), (4) Date: Apr. 6, 2011

(87) PCT Pub. No.: WO2010/041281
PCT Pub. Date: Apr. 15, 2010

(65) Prior Publication Data
US 2011/0203508 A1 Aug. 25, 2011

(51) Int. Cl.
*B63B 29/12* (2006.01)

(52) U.S. Cl.
USPC ..... 114/191

(58) Field of Classification Search
USPC ..... 114/191–195
See application file for complete search history.

(56) References Cited

U.S. PATENT DOCUMENTS

| | | | | |
|---|---|---|---|---|
| 3,658,286 | A * | 4/1972 | Terai et al. | 248/371 |
| 7,490,572 | B2 * | 2/2009 | Grober | 114/191 |
| 2004/0208499 | A1 | 10/2004 | Grober | |

FOREIGN PATENT DOCUMENTS

| | | |
|---|---|---|
| DE | 35 43 140 | 6/1987 |
| DE | 196 43 598 | 4/1998 |
| GB | 2 440 520 | 2/2008 |

* cited by examiner

*Primary Examiner* — Edwin Swinehart
(74) *Attorney, Agent, or Firm* — King & Schickli, PLLC

(57) ABSTRACT

A self-levelling system comprising a base (10) fixed onto a first external load-bearing structure subjected to natural stressing forces, a second internal flat structure (21) which is to be self-levelled, and a movable fixing system between said first and second structure. Said movable fixing system comprises a cylindrical element (13) slidable vertically along a base guide (11) on the basis of a first command, and fixed at one end to said base and at its other end to a ball joint (20), said ball joint being fixed to said second structure, a first actuator (24) associated between said cylindrical element (13) and said second structure (21), said first actuator (24) being operated on the basis of a second command, a second actuator (25) associated between said cylindrical element (13) and said second structure (21), said second actuator being operated on the basis of a third command, said first actuator being associated with said second structure at a first point, said second actuator being associated with said second structure at a second point, said first point being positioned on a first axis and said second point being positioned on a second axis, said first axis and said second axis being mutually perpendicular.

3 Claims, 3 Drawing Sheets

SYSTEM AND METHOD FOR LEVELLING A PLANE WITH RESPECT TO A MOVABLE REFERENCE

This application is the national stage of PCT/IT2008/000634, filed Oct. 7, 2008, the disclosure of which is incorporated herein by reference.

DESCRIPTION

1. Field of the Invention

The present invention relates to a system and method for self-levelling a plane with respect to a movable reference, in particular with respect to a boat.

2. Background of the Invention

During navigation, a boat is known to be stressed by sea wave forces which cause the boat to roll and pitch.

In particular, in the presence of particularly rough sea the boat undergoes considerable movements which can cause passengers to suffer so-called sea-sickness.

In this respect, about six Italians in ten suffer from movement sickness, such as car, air or sea sickness, with the relative symptoms known by all.

In the case of rough sea, even seasoned seafarers can suffer from some disturbance e/or have difficulty in handling the boat because of its movements.

SUMMARY OF THE INVENTION

An object of the present invention is to provide a system and method for self-levelling a plane with respect to a movable reference, in particular with respect to a boat, by which the aforesaid drawbacks are eliminated.

This and further objects are attained according to the present invention by a self-levelling system comprising a base fixed onto a first external load-bearing structure subjected to natural stressing forces, a second internal flat structure which is to be self-levelled, and a movable fixing system between said first and second structure, characterised in that said movable fixing system comprises a cylindrical element slidable vertically along a base guide on the basis of a first command, said cylindrical element being fixed at one end to said base and at its other end to a ball joint, said ball joint being fixed to said second structure, a first actuator associated between said cylindrical element and said second structure, said first actuator being operated on the basis of a second command, a second actuator associated between said cylindrical element and said second structure, said second actuator being operated on the basis of a third command, said first actuator being associated with said second structure at a first point, said second actuator being associated with said second structure at a second point, said first point being positioned on a first axis and said second point being positioned on a second axis, said first axis and said second axis being mutually perpendicular.

These objects are also attained by a method for self-levelling a plane positioned on a base associated with a first external load-bearing structure subjected to natural stressing forces, said plane being associated with said first structure via a ball joint, comprising the steps of: operating a first and a second actuator on the basis of a first and a second command; varying the pressure of a fluid within a chamber positioned between a piston and a cylindrical element on the basis of a third command; generating said first, second and third command on the basis of a measurement by a plurality of sensors.

Further characteristics of the invention are described in the dependent claims.

When sitting or lying on the plane of the present invention, the inconvenience of so-called sea-sickness to persons present on a boat can be reduced, if not eliminated.

The self-levelling system of the present invention is able to counterbalance the movements of the boat, completely if these movements are small, or partially if the movements of the boat exceed in extent those enabled by the system.

In this latter case, by virtue of appropriate controls, by acting on the response rate of the drive actions it is still possible to considerably reduce the inconvenience due to sea-sickness.

If the present invention is used for the command post on a boat, the captain can be helped to remain in a stable position even in rough sea, and hence proceed with greater safety.

BRIEF DESCRIPTION OF THE DRAWING FIGURES

The characteristics and advantages of the present invention will be apparent from the ensuing detailed description of one embodiment thereof, illustrated by way of non-limiting example in the accompanying drawings, in which.

DETAILED DESCRIPTION OF THE INVENTION

Figure 1:
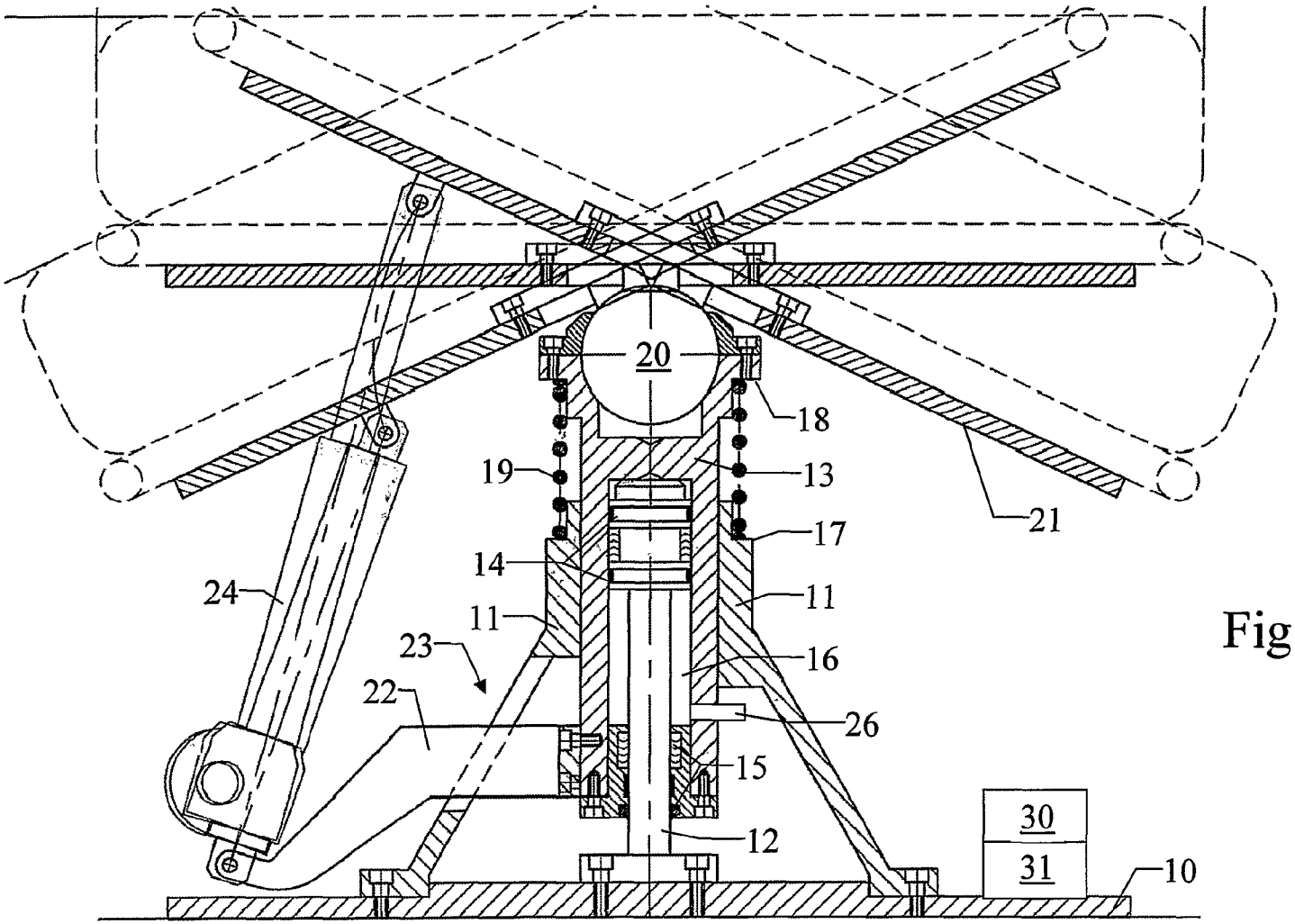
FIG. 1 is a partly sectional schematic front view of a system according to the present invention.
Figure 2:
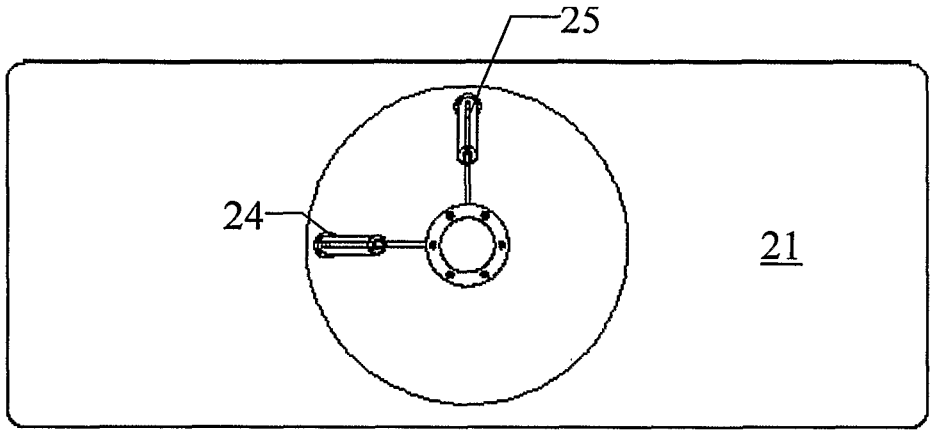
FIG. 2 is a partly sectional schematic view from above of a system according to the present invention.
Figure 3:
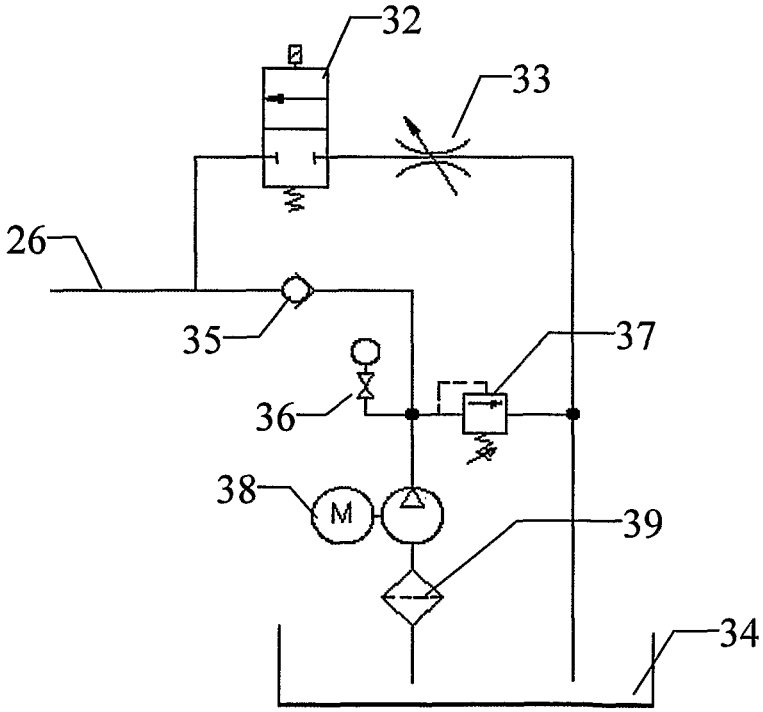
FIG. 3 shows schematically an operating circuit for an actuator of FIG. 1, in accordance with the present invention.
Figure 4:
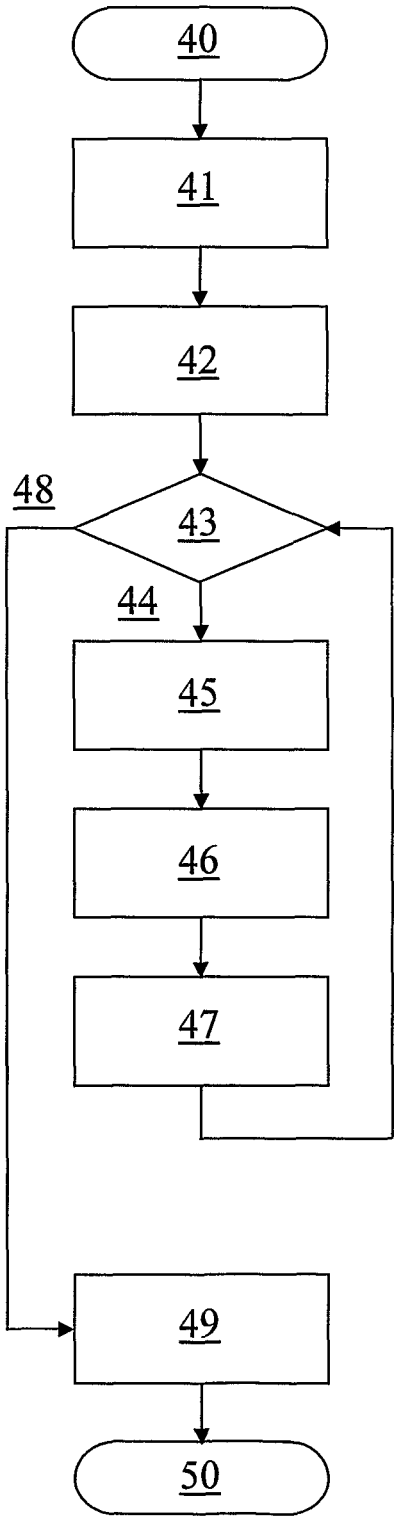
FIG. 4 is a schematic view of a flow diagram for implementing the system of the present invention.

The present invention relates to a first external load-bearing structure subjected to natural stressing forces; a second internal flat structure which is to be self-levelled; and a fixing system between the two structures; the two structures being fixed together rigidly but mutually movable.

This type of fixing implies that the stresses applied to the first external structure are transmitted equally to the second internal flat structure.

Typical examples of this reality can be for example a boat (external structure) and a bed or seat positioned within the boat (internal structure).

The objective of the present invention is to make the first flat internal structure independent of the stresses applied to the second external structure such that its behaviour reflects a natural behaviour which would be achieved in the total absence of external stresses. This result is achieved by interposing between the external structure and the reference table a self-levelling device provided with sensors, actuators and servomechanisms which measure the external stresses and modify the mutual position between the fixing planes of the external structure and the flat internal structure, to reproduce in the direction opposite to the interior of the fixing structure the stresses undergone by the external structure. The fixing structure, from being rigid and solid, evolves towards a fixing system movable in the three main stressing directions (x, y, z axes).

In particular, the stressing effect perceived by the second structure is aimed at being comparable to that normally perceived in the total absence of contrasting forces.

If the excursions undergone by the first external structure are greater than those withstandable by the second internal structure, the system applies a proportionality criterion.

Referring to the accompanying figures, a system for self-levelling a plane with respect to a movable reference, according to the present invention, comprises a base 10 for fixing the system to a boat, not shown. A support structure 11 of inverted frusto-conical shape and having a central hole is fixed to and extends from this base 10.

A piston 12, positioned on the same axis as the frusto-conical structure 11, is also fixed on this base.

Two gaskets 14 are positioned at the upper end of the piston 12, although one could be sufficient.

The system comprises a cylindrical element 13, which can slide within the frusto-conical structure 11. The inner upper portion of the structure 11 has an inner cylindrical surface which mates with the outer surface of the element 13.

The cylindrical element 13 is internally hollow, where the piston 12 can slide. The piston 12 has as its upper guide a gasket 14, and lowerly has a restriction in the cylindrical element 13, also comprising gaskets 15.

About the piston 12, between the gaskets 14 and the gaskets 15, a vertically extending annular area 16 is formed, in which a pressurized fluid is inserted to provide the vertical movement of the piston 12. The fluid is controlled by a hydraulic circuit connected to the pipe 26.

The upper outer surface of the frusto-conical structure 11 comprises a circular ledge 17 rigid with it.

The cylindrical element 13, at its outer upper end, also comprises a ledge 18 in a position opposing the ledge 17.

A spring 19 is located between the two ledges 17 and 18.

The upper end of the cylindrical element 13 comprises a ball joint 20 composed of a ball able to rotate within its seat. A plane member 21 is fixed to the ball, to hence be able to move in any direction.

The plane member 21 can be the base of a bed or of a chair or of any other element present on a boat which is to be self-levelled.

Two mutually perpendicular arms 22 are fixed to the lower end of the cylindrical element 13 to extend outwards from the frusto-conical structure 11, which in this region presents an aperture 23.

At their most outer end from the cylindrical element 13, the arms 22 are connected by two hinges to two actuators 24 and 25. The two actuators 24 and 25 are connected to the plane member 21 at two separate points positioned on two axes at 90° apart, such as to move the plane member 21 into any desired position.

The actuators 24 and 25 can be of various types, for example pneumatic.

The system also comprises a series of sensors 30 and a processing and operational centre 31.

The sensors 30, preferably positioned on the base 10, are required to provide information of the boat movements along the three axes x, y and z.

The sensors for measuring the angular deviation can consist of potentiometric or linear sensors, these consisting of a rod hinged at its upper end and free to position itself by gravity at its lower end.

The distance between the top of the rod and a reference point rigid with the external structure enables the angular deviation to be measured.

The sensor used on the Z-axis uses a system enabling the vertical acceleration to be measured and can be in the form of accelerometers or a body having sufficient inertia towards vertical displacement.

The distance between this latter and a reference point fixed to the external structure allows measurement of the forces and deviations in play; in this case the measurement can be made with the aid of laser equipment.

The processing and operational centre 31 is composed of an electronic apparatus provided with a microprocessor which processes the data originating from the sensors 30 to produce the command signals to send to the control cards for the actuators 12, 13 and 24, using a proportional voltage or current system.

The apparatus can consist of a suitably designed dedicated card or a PLC.

With both solutions the apparatus can be interfaced with a small-dimension PC used to display the operating state of the apparatus while at the same time enabling selection of personalized programmes allowing diversified and/or personalized corrective actions.

The hydraulic control circuit for the fluid located in the area 16 comprises the pipe 26 connected to a solenoid valve 32 followed by an adjustable constriction 33, the output of which flows into a tank 34.

The pipe 26 is also connected to a non-return valve 35, then to a pressure gauge 36, to a pump connected to a motor 38, then to a filter 39, the output of which flows into the tank 34.

A maximum pressure valve 37 is connected between the pressure gauge 36 and the adjustable constriction 33.

The pump 38 is operated to increase the fluid pressure, while to reduce the pressure the solenoid valve 32 is operated. The pressure reduction rate is regulated by the constriction 33.

The operation of the device of the invention is apparent from that described and illustrated, and is substantially as follows.

The boat moves under the influence of rough sea, the sensors 30 measuring its movement, the centre 31 processing the counter-measures to be applied to the plane member 21 for stabilizing and levelling it to the greatest possible extent.

The actuators 12, 13, 24 and 25 are then suitably operated. The plane member 21 can be suitably positioned and inclined by means of the ball joint 20 to counteract the movement of the boat.

The combined piston 12 and cylindrical element 13 compensates the boat vertical movements. The actuators 24 and 25 compensate the boat pitch and roll.

With reference to FIG. 1, the cylindrical element 13 lies in its lower position, as the pressurized fluid within the space 16 urges the cylindrical element 13 downwards. By extracting fluid or reducing its pressure, in combination with the force exerted by the spring 19, the cylindrical element 13 can be positioned where required.

The system formed by the centre 31 acts as follows.

When the overall system is switched on at 40, the sensors of the various axes x, y and z are calibrated at 41.

After this, the actuators are positioned in their rest position at 42.

Self-levelling is then effectively activated at 43.

If all is well, it proceeds through 44 to read the sensors 30 at 45.

The extent of control of each actuator is calculated at 46 and the actuators commanded at 47.

After this it continues by verifying that self-levelling has been effectively activated at 43.

If activation is found negative via 48, the actuators are positioned in their rest position at 49, the system possibly being switched off at 50. The aforesaid considerations are applicable if the fulcrum of the point of interest corresponds exactly to the fulcrum of the external load-bearing structure, otherwise the effect of translation must also be considered along the perpendicular flat components referred to the fixing plate 10 fixed to the external structure.

The extent of the correction factor to be applied is calculated by trigonometric formulas based on the respective position of the external structure and internal structure.

A more refined control, which takes account of these aspects, can be achieved by interposing an intelligent processing part between the measurement part and the mover part, compared with the preceding scheme in which each axis operated independently of the others.

Those measurements taken by the sensors used for measuring the angular inclination of the boat in its longitudinal and transverse direction, and the vertical deviation, will now be considered.

Assuming that a potentiometric sensor powered by constant reference voltage is used, the angular inclination of the boat can be obtained by measuring the voltage between the negative pole and the intermediate position of the potentiometric sensor.

Assuming a 330° circular potentiometer fed with 10V is used, the angular deviation can be calculated by the following formula:

Excursion (E)=330°

Power (T)=10000 mV

Reading (L)=4850 mV

Degrees=E/2−E/T*L=4.95

To measure the vertical deviation of the boat, assuming a sensor is used presenting a certain inertia towards vertical acceleration of the boat, the measurement of the distance travelled can be obtained by considering the intensity of the signal measured per unit of its sampling time.

To correct the lateral inclination of the boat, the previously calculated value measured by the lateral angular sensor is used to equally reproduce a voltage to be used to command the lateral actuator for the plane member.

Assuming an actuator controlled from −5,000 mV to +5,000 mV and with maximum excursion from −50° to +50°, the extent of the signal to be applied is given by the following formula:

Excursion (E)=50° (+−)

Control voltage (V)=5000 mV (+−)

Degrees of correction=G=E/2−E/T*L=4.95

Signal mv=G*V/E

The above relationships are also valid to correct the longitudinal inclination of the boat.

Seeing that the corrections, for equal lateral and longitudinal inclination, are different and assume a different sign on the basis of their system positioning towards bow or towards stern, four typical positions are therefore considered: one at bow positioned to the right P1, one at bow positioned to the left P2, one at stern positioned to the left P3, one at stern positioned to the right P4.

The angular measurements are considered positive if orientated in the clockwise sense about the mast of the boat or are considered negative in sign if otherwise.

The angle formed with respect to the lateral view of the boat (Y and X axes) is called Alpha, while that formed with respect to the longitudinal view (Y and Z axes) is called Beta.

The distance between the boat barycentre and the that of the plane member is called Side_X, Side_Y, Side_Z on the basis of the previously defined boat directions.

The three actuators disposed along the X, Y and Z axes are called respectively ACT_X, ACT_Y, ACT_Z Assuming inclinations with positive angulations, the corrections (C1-C4) for each actuator ACT_X, ACT_Y, ACT_Z referred to the positions P1-P4 are as follows:

ACT_Y_1=Side_X*Sine(Modulus(Alpha))+Side_Z*Sine(Modulus(Beta)+Vertical sensor measurement ACT_Y_2=−Side_X*Sine(Modulus(Alpha))+Side_Z*Sine(Modulus(Beta)+Vertical sensor measurement ACT_Y_3=−Side_X*Sine(Modulus(Alpha))−Side_Z*Sine(Modulus(Beta)+Vertical sensor measurement ACT_Y_4=Side_X*Sine(Modulus(Alpha))−Side_Z*Sine(Modulus(Beta)+Vertical sensor measurement ACT_X_1=Side_X*(1−Cosine(Modulus(Alpha)))

ACT_X_2=−Side_X*(1−Cosine(Modulus(Alpha)))

ACT_X_3=−Side_X*(1−Cosine(Modulus(Alpha)))

ACT_X_4=Side_X*(1−Cosine(Modulus(Alpha)))

ACT_Z_1=Side_X*(1−Sine(90−Modulus(Beta)))

ACT_Z_2=−Side_X*(1−Sine(90−Modulus(Beta)))

ACT_Z_3=−Side_X*(1−Sine(90−Modulus(Beta)))

ACT_Z_4=Side_X*(1−Sine(90−Modulus(Beta)))

The extents of the corrections to be applied will be used to calculate the voltage to be applied to the controller of the actuator X, Y and Z in accordance with the manner previously described.

On the basis of the preceding considerations, the given formulas are valid for inclinations which produce angulations of positive sign; if these latter are of different sign, the sign of the correction to be applied to the individual actuators must be inverted, using the same listed calculation methods. The possible combinations are: Alpha positive and Beta positive, Alpha negative and Beta positive, Alpha positive and Beta negative, Alpha negative and Beta negative. Considering the identical method of calculation of the extent of correction to be applied referred to each possible combination, it is considered unnecessary to define each individual formula for all four possible cases (the difference consists of the sign of each component based on the sign of the corresponding angle Alpha and Beta).

The system described herein is not further detailed as an expert of the art, based on the aforegoing, is able to implement it.

The materials used and the dimensions can be chosen at will according to requirements and to the state of the art.

The system conceived in this manner is susceptible to numerous modifications and variants, all falling within the scope of the inventive concept; moreover all details can be replaced by technically equivalent elements.

The invention claimed is:

1. A self-levelling system comprising a base (10) fixed onto a first external load-bearing structure subjected to natural stressing forces, said first external load-bearing structure is a boat, a second internal flat structure (21) which is to be self-levelled, and a movable fixing system between said first and second structure (21), said second structure (21) is a bed or a chair, characterised in that said movable fixing system comprises a cylindrical element (13) slidable vertically along a base guide (11) on the basis of a first command, said base guide (11) is fixed to said base (10), said base guide (11) comprises a piston (12) fixed to said base (10) on which said cylindrical element (13) externally slides; between said piston and said cylindrical element an annular space being formed in which a fluid is located, its pressure being controlled by said first command; said cylindrical element (13) being fixed at one end to a ball joint (20), said ball joint (20) being fixed to said second structure (21), a first actuator (24) associated between said cylindrical element (13) and said second structure (21), said first actuator (24) is connected by means of a hinge to a perpendicular arm (22) fixed to the lower end of said cylindrical element (13); said first actuator (24) being operated on the basis of a second command, a second actuator (25) associated between said cylindrical element (13) and said second structure (21), said second actuator (25) is connected by means of a hinge to a perpendicular arm (22) fixed to the lower end of said cylindrical element (13); said second actuator (25) being operated on the basis of a third command, said first actuator (24) being associated with said second structure (21) at a first point, said second actuator (25)

being associated with said second structure (21) at a second point, said first point being positioned on a first axis and said second point being positioned on a second axis, said first axis and said second axis being mutually perpendicular; said first, second and third command are generated by a control centre (31) which receives information from sensors (30) able to provide an indication of the movements of said first load-bearing structure along the three X, Y and Z axes.

2. A system as claimed in claim 1, characterised in that said control centre (31) calculates said corrections to be applied in the case in which said system is not positioned in the vicinity of the barycentre of said first external load-bearing structure.

3. A system as claimed in claim 1, characterised in that a spring is positioned between said cylindrical element and said support structure.

* * * * *